US010168648B2

(12) United States Patent
Koyanagi et al.

(10) Patent No.: US 10,168,648 B2
(45) Date of Patent: Jan. 1, 2019

(54) FIXING DEVICE AND IMAGE FORMING APPARATUS

(71) Applicant: FUJI XEROX CO., LTD., Tokyo (JP)

(72) Inventors: Kiyoshi Koyanagi, Kanagawa (JP); Toru Inoue, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/698,811

(22) Filed: Sep. 8, 2017

(65) Prior Publication Data

US 2018/0267441 A1 Sep. 20, 2018

(30) Foreign Application Priority Data

Mar. 15, 2017 (JP) ..... 2017-050177

(51) Int. Cl.
*G03G 15/20* (2006.01)

(52) U.S. Cl.
CPC ..... *G03G 15/2017* (2013.01); *G03G 15/2039* (2013.01)

(58) Field of Classification Search
CPC ..... G03G 15/2017; G03G 15/2039; G03G 15/2042; G03G 15/2053; G03G 15/2057; G03G 15/2078; G03G 15/2082; G03G 2215/2022; G03G 2215/2035
See application file for complete search history.

(56) References Cited

U.S. PATENT DOCUMENTS

2005/0232664 A1* 10/2005 Tomita ..... G03G 15/2064 399/329
2014/0138372 A1* 5/2014 Ogura ..... G03G 15/2042 219/216
2016/0170338 A1* 6/2016 Tateishi ..... G03G 15/2053 399/329

FOREIGN PATENT DOCUMENTS

JP 11-84919 A 3/1999
JP 2009-139822 A 6/2009
JP 2012073345 A * 4/2012

* cited by examiner

*Primary Examiner* — Thomas S Giampaolo, II
(74) *Attorney, Agent, or Firm* — Sughrue Mion, PLLC

(57) ABSTRACT

A fixing device includes a belt member used to fix an image on a recording material; a heating source that has a facing surface facing the belt member and an opposite surface and heats the belt member; a heat receiving member that is disposed in contact with the opposite surface of the heating source and receives heat from the heating source; and a temperature detector that is provided on an opposite surface side of the heating source and detects temperature of the heating source without interposition of the heat receiving member between the heating source and the temperature detector.

18 Claims, 9 Drawing Sheets

FIG. 5A
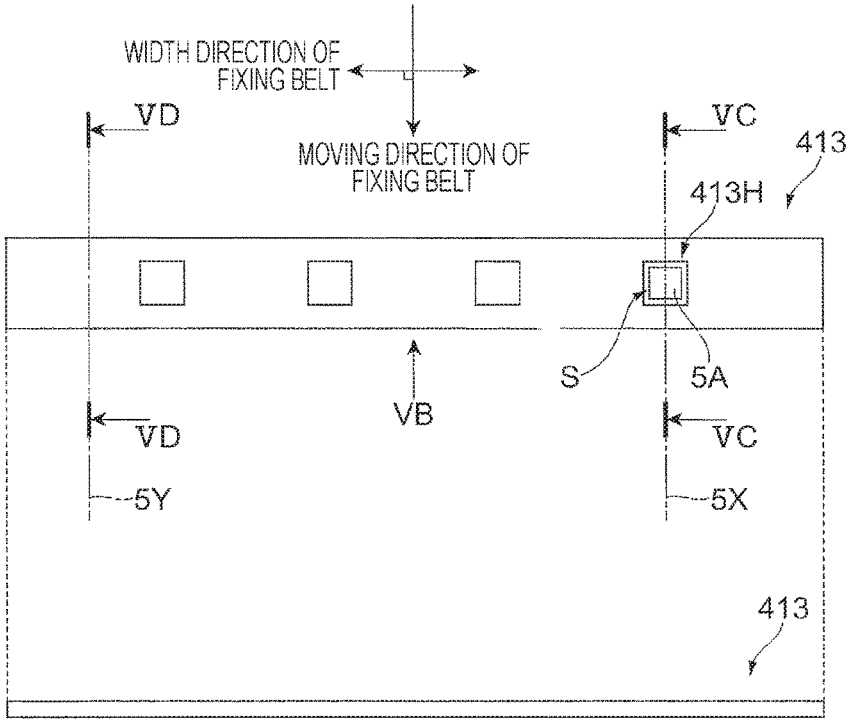
FIG. 5B
FIG. 5C
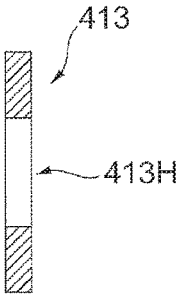
FIG. 5D
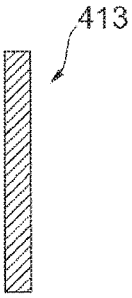

FIG. 6A
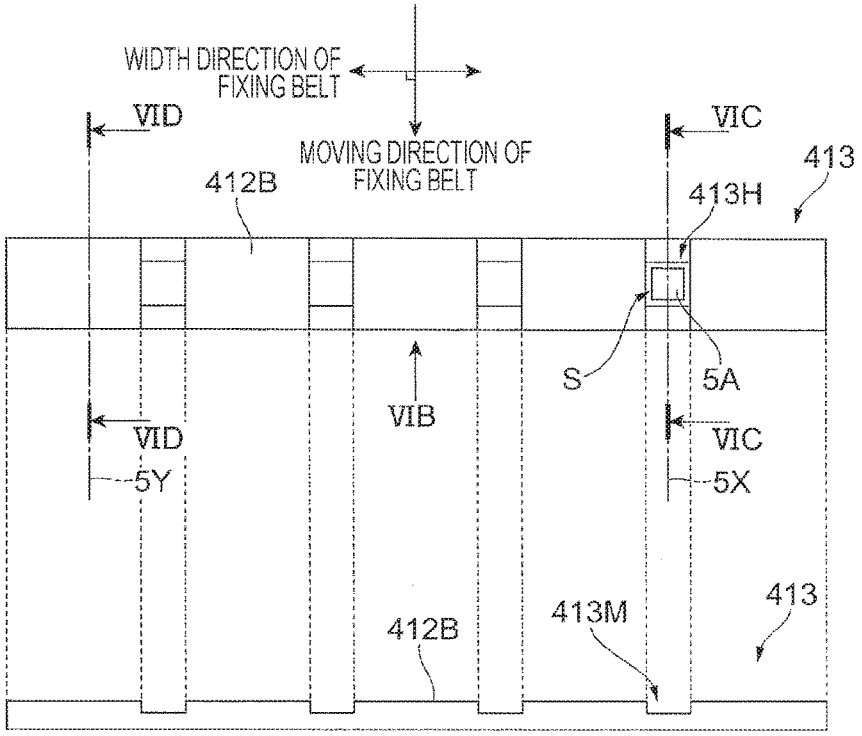
FIG. 6B
FIG. 6C
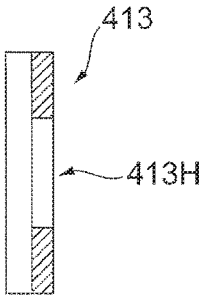
FIG. 6D
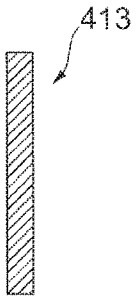

FIG. 7A
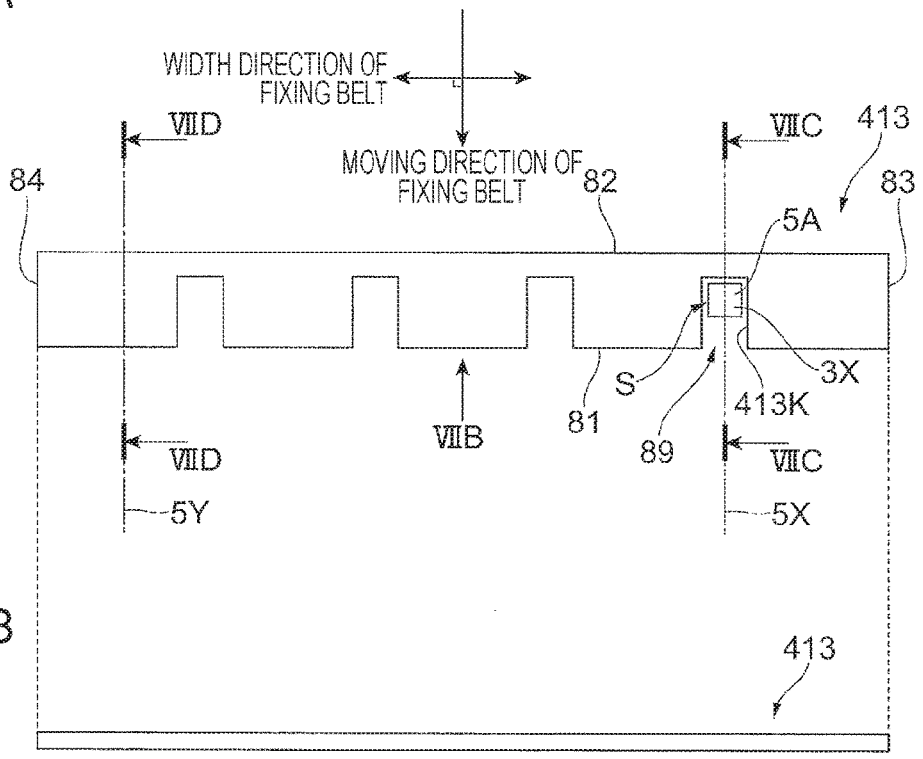
FIG. 7B
FIG. 7C
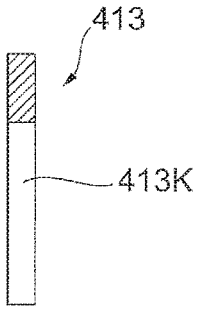
FIG. 7D
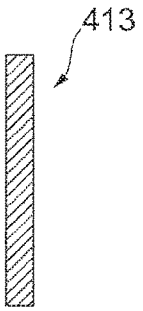

FIXING DEVICE AND IMAGE FORMING APPARATUS

CROSS-REFERENCE TO RELATED APPLICATIONS

This application is based on and claims priority under 35 USC 119 from Japanese Patent Application No. 2017-050177 filed Mar. 15, 2017.

BACKGROUND

Technical Field

The present invention relates to a fixing device and an image forming apparatus.

SUMMARY

According to an aspect of the invention, there is provided a fixing device including: a belt member used to fix an image on a recording material; a heating source that has a facing surface facing the belt member and an opposite surface and heats the belt member; a heat receiving member that is disposed in contact with the opposite surface of the heating source and receives heat from the heating source; and a temperature detector that is provided on an opposite surface side of the heating source and detects temperature of the heating source without interposition of the heat receiving member between the heating source and the temperature detector.

BRIEF DESCRIPTION OF THE DRAWINGS

An exemplary embodiment of the present invention will be described in detail based on the following figures, wherein:

FIG. 5A through 5D are views for illustrating a heat receiving member;

FIGS. 6A through 6D illustrate another example of the configuration of the heat receiving member;

FIGS. 7A through 7D illustrate another example of the configuration of the heat receiving member;

DETAILED DESCRIPTION

An embodiment of the present invention is described below with reference to the attached drawings.

Figure 1:
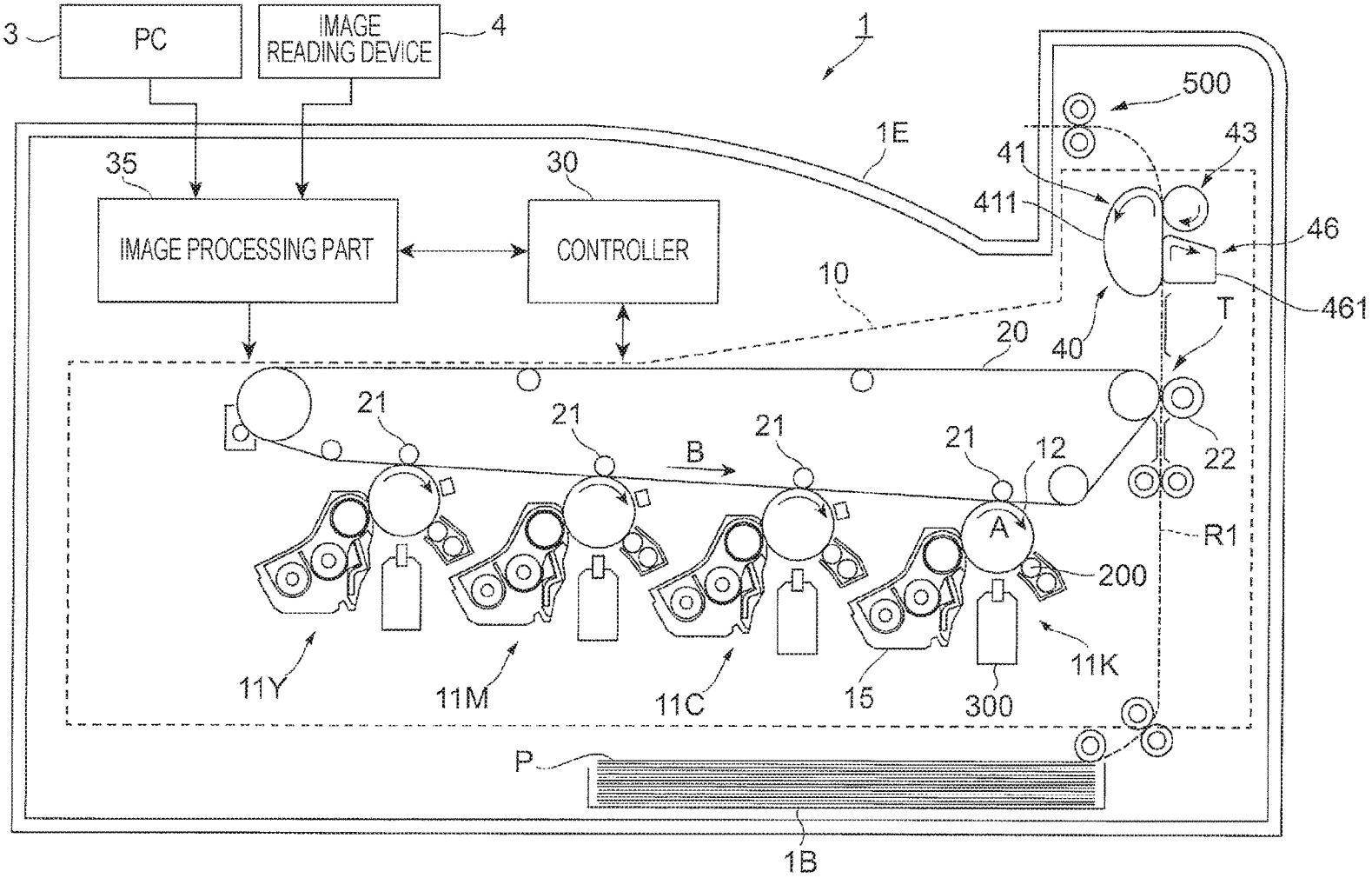
FIG. 1 illustrates an overall configuration of an image forming apparatus.

FIG. 1 illustrates an overall configuration of an image forming apparatus 1.

The image forming apparatus 1 is a tandem-type color printer. The image forming apparatus 1 includes an image forming part 10 that is an example of an image forming part. The image forming part 10 forms an image on a sheet of paper P that is an example of a recording material on the basis of image data of respective colors.

Furthermore, the image forming apparatus 1 includes a controller 30 and an image processing part 35. The controller 30 controls functional units provided in the image forming apparatus 1. The image processing part 35 performs image processing on image data supplied, for example, from a personal computer (PC) 3 or an image reading device 4.

The image forming part 10 includes four image forming units 11Y, 11M, 11C, and 11K (hereinafter sometimes collectively referred to simply as "image forming units 11") that are disposed in parallel at constant intervals.

The image forming units 11 have a similar configuration except for toner contained in a developing device 15 (described later). The image forming units 11 form yellow (Y), magenta (M), cyan (C), and black (K) toner images (images), respectively.

Each of the image forming units 11 includes a photoconductor drum 12, a charging device 200 that charges the photoconductor drum 12, and an LED print head (LPH) 300 that exposes the photoconductor drum 12 to light. The photoconductor drum 12 is charged by the charging device 200. Furthermore, the photoconductor drum 12 is exposed to light by the LPH 300, and thus an electrostatic latent image is formed on the photoconductor drum 12.

Furthermore, each of the image forming units 11 includes a cleaner (not illustrated) that cleans a surface of the photoconductor drum 12 and the developing device 15 that develops an electrostatic latent image formed on the photoconductor drum 12.

Furthermore, the image forming part 10 includes an intermediate transfer belt 20 onto which toner images of respective colors formed on the photoconductor drums 12 are transferred and first transfer rolls 21 that sequentially transfer (first transfer), onto the intermediate transfer belt 20, the toner images of the respective colors formed on the photoconductor drums 12.

Furthermore, the image forming part 10 includes a second transfer roll 22 that collectively transfers (second transfer), onto the sheet of paper P, the toner images transferred onto the intermediate transfer belt 20 and a fixing device 40 that fixes, on the sheet of paper P, the toner images thus transferred onto the sheet of paper P.

The fixing device 40 includes a heating belt module 41 including a heating source, a driving roll 43, and a pressing belt module 46.

The heating belt module 41 is disposed on the left of a paper transporting path R1 in FIG. 1. The heating belt module 41 includes a fixing belt 411 that is an example of a belt member. The fixing belt 411 is an endless belt and circulates in a counterclockwise direction in FIG. 1. The heating belt module 41 includes the heating source (described later) that is provided on an inner side of the fixing belt 411.

The driving roll 43 that is an example of a downstream side pressing member is disposed on the right of the paper transporting path R1 in FIG. 1. The driving roll 43 is pressed against an outer circumferential surface of the fixing belt 411 and presses the sheet of paper P (the sheet of paper P passing the paper transporting path R1) transported between the fixing belt 411 and the driving roll 43.

The driving roll 43 is rotated in a clockwise direction in FIG. 1 by a motor (not illustrated in FIG. 1). When the driving roll 43 rotates in the clockwise direction, the fixing belt 411 rotates in a counterclockwise direction by receiving driving force from the driving roll 43.

The pressing belt module 46 that is one example of an upstream side pressing member is disposed on the right of the paper transporting path R1 in FIG. 1. The pressing belt module 46 is disposed on an upstream side in a moving direction of the fixing belt 411 relative to the driving roll 43.

The pressing belt module 46 is pressed against the fixing belt 411 and presses the sheet of paper P transported between the fixing belt 411 and the pressing belt module 46 (the sheet of paper P transported on the paper transporting path R1). The pressing belt 461 of the pressing belt module 46 rotates in the clockwise direction in FIG. 1 by receiving driving force from the fixing belt 411.

In the image forming apparatus 1, the image processing part 35 performs image processing on image data supplied from the PC 3 or the image reading device 4, and the image data that has been subjected to the image processing is supplied to the image forming units 11. Then, for example, in the image forming unit 11K for black (K), the photoconductor drum 12 is charged by the charging device 200 while rotating in a direction indicated by the arrow A and is exposed to light by the LPH 300 that emits light on the basis of the image data transmitted from the image processing part 35.

In this way, an electrostatic latent image concerning a black (K) image is formed on the photoconductor drum 12. Then, the electrostatic latent image formed on the photoconductor drum 12 is developed by the developing device 15, and thus a black (K) toner image is formed on the photoconductor drum 12.

Similarly, in the image forming units 11Y, 11M, and 11C, yellow (Y), magenta (M), and cyan (C) toner images are formed, respectively.

The toner images of the respective colors formed in the image forming units 11 are sequentially electrostatically adsorbed onto the intermediate transfer belt 20 moving in a direction indicated by the arrow B by the first transfer roll 21, and the toner images of the respective colors are thus superimposed on the intermediate transfer belt 20 so as to form a toner image.

The toner image formed on the intermediate transfer belt 20 is transported to a portion (a second transfer portion T) where the second transfer roll 22 is located by movement of the intermediate transfer belt 20. The sheet of paper P is supplied from a paper containing part 1B to the second transfer portion T in synchronization with a timing at which the toner image is transported to the second transfer portion T.

In the second transfer portion T, the toner images on the intermediate transfer belt 20 are collectively electrostatically transferred onto the sheet of paper P by a transfer electric field formed by the second transfer roll 22.

Then, the sheet of paper P on which the toner images have been electrostatically transferred is peeled off from the intermediate transfer belt 20 and is transported to the fixing device 40.

In the fixing device 40, the sheet of paper P is nipped between the heating belt module 41 and the pressing belt module 46 and is nipped between the heating belt module 41 and the driving roll 43. In this way, the sheet of paper P is pressed and heated, and thus the toner image on the sheet of paper P is fixed on the sheet of paper P.

The sheet of paper P on which the toner image is fixed is transported to a paper stacking part 1E by a discharge roll 500.

Figure 2:
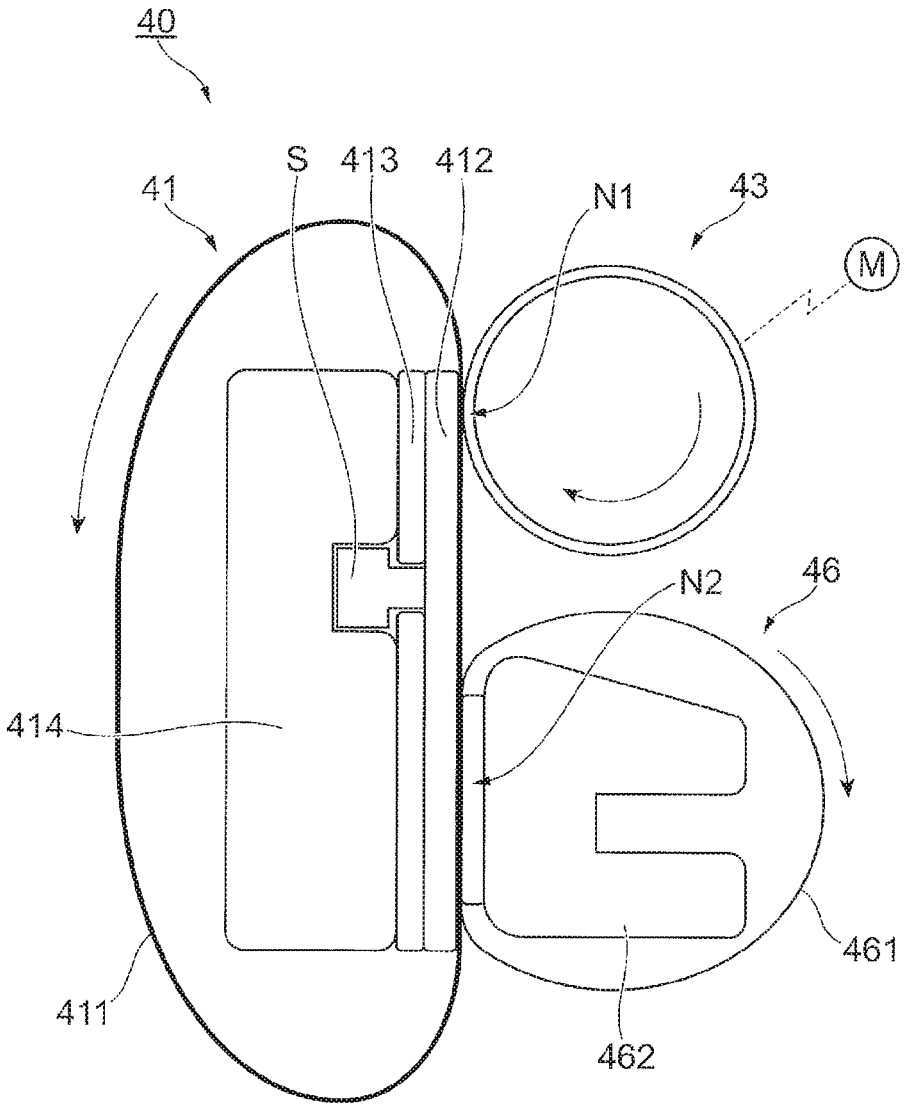
FIG. 2 is a view for illustrating a configuration of a fixing device.

FIG. 2 is a view for illustrating a configuration of the fixing device 40.

The fixing device 40 includes the heating belt module 41, the driving roll 43, and the pressing belt module 46.

The heating belt module 41 includes the fixing belt 411 used to fix the toner image on the sheet of paper P. The fixing belt 411 rotates in a counterclockwise direction in FIG. 2.

The heating source 412 that has a plate shape extending in the moving direction of the fixing belt 411 and a width direction of the fixing belt 411 (orthogonally to the paper on which FIG. 2 is drawn) is provided on an inner side of the fixing belt 411. In other words, a planar heat generator that extends in the moving direction of the fixing belt 411 and the width direction of the fixing belt 411 is provided on an inner side of the fixing belt 411.

In the present exemplary embodiment, the fixing belt 411 is heated by the heating source 412.

Furthermore, the heating belt module 41 includes a temperature sensor S that is an example of a temperature detector. The temperature sensor S is located so as to face the heating source 412 and detects temperature of the heating source 412.

Furthermore, the heating belt module 41 includes a heat receiving member 413 that is disposed in contact with the heating source 412 and receives heat from the heating source 412. In other words, the heating belt module 41 includes a heat capacity body that receives heat from the heating source 412 and accumulates this heat.

The heat receiving member 413 is made of a material having high heat conductivity and a large heat capacity. Specifically, the heat receiving member 413 is made of a metal material such as copper.

Furthermore, the heating belt module 41 includes a support member 414 on an inner side of the fixing belt 411. The support member 414 supports members (e.g., the heating source 412, the heat receiving member 413, and the temperature sensor S) disposed on an inner side of the fixing belt 411. The support member 414 is made of a resin material having resistance to heat and has a heat blocking function.

The driving roll 43 rotates in a clockwise direction in FIG. 2 by receiving driving force from a motor M. In a downstream side contact portion N1, the driving roll 43 is in contact with the outer circumferential surface of the fixing belt 411.

In the present exemplary embodiment, when the driving roll 43 rotates in the clockwise direction in FIG. 2, the fixing belt 411 rotates in a counterclockwise direction in FIG. 2 by receiving driving force from the driving roll 43.

The pressing belt module 46 is disposed in contact with the fixing belt 411. Specifically, in the present exemplary embodiment, in an upstream side contact portion N2 located on an upstream side of the downstream side contact portion N1, the fixing belt 411 of the heating belt module 41 and the pressing belt module 46 are in contact with each other.

The pressing belt module 46 includes the pressing belt 461 that presses the sheet of paper P. The pressing belt 461 rotates in the clockwise direction in FIG. 2 by receiving driving force from the fixing belt 411.

Furthermore, the pressing belt module 46 includes a pressing member 462 on an inner side of the pressing belt 461. The pressing member 462 is pressed against the support member 414 (the support member 414 of the heating belt module 41) with the fixing belt 411 and the pressing belt 461 interposed therebetween.

In the present exemplary embodiment, the sheet of paper P is pressed and heated in the upstream side contact portion N2 and the downstream side contact portion N1 while being transported to a downstream side. This causes the toner image on the sheet of paper P to be fixed on the sheet of paper P.

In the present exemplary embodiment, in which the sheet of paper P is pressed and heated in two portions, i.e., the upstream side contact portion N2 and the downstream side contact portion N1, the sheet of paper P is heated over a longer region, for example, than in a case where the sheet of paper P is pressed and heated by using only a pair of roll members that are pressed against each other (than in a case where the sheet of paper P is pressed and heated in a single portion). In this case, more heat may be given to the sheet of paper P. This may lower a fixing temperature. Accordingly, the fixing process may be performed by using smaller energy.

Figure 3:
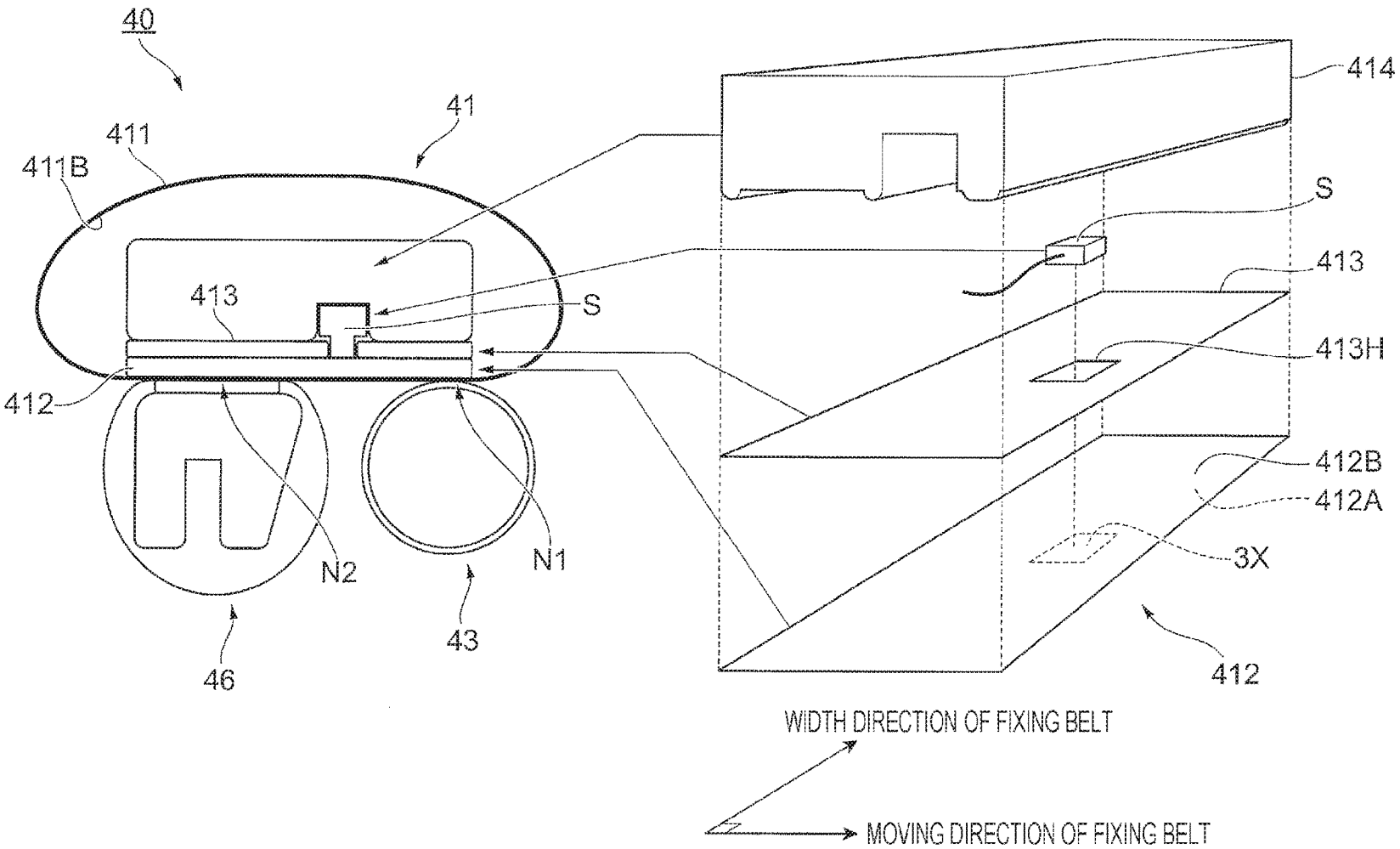
FIG. 3 is a view for illustrating an internal configuration of a heating belt module.

FIG. 3 is a view for illustrating an internal configuration of the heating belt module 41.

The heating belt module 41 includes the heating source 412 having a plate shape as described above. The heating source 412 is provided from the upstream side contact portion N2 to the downstream side contact portion N1.

Furthermore, the heating source 412 is disposed so as to face the inner circumferential surface 411B of the fixing belt 411 and has a facing surface 412A that faces the inner circumferential surface 411B of the fixing belt 411 and an opposite surface 412B opposite to the facing surface 412A.

Furthermore, the heating belt module 41 includes the heat receiving member 413 having a plate shape that receives heat from the heating source 412 as illustrated in FIG. 3.

The heat receiving member 413 has the same size as the heating source 412. The heat receiving member 413 is disposed so as to overlap the heating source 412 and be in contact with the opposite surface 412B of the heating source 412.

A dimension of the heat receiving member 413 in a width direction of the fixing belt 411 (in a direction that crosses (is orthogonal to) the moving direction of the fixing belt 411) is larger than a dimension of the heat receiving member 413 in the moving direction of the fixing belt 411. In other words, the heat receiving member 413 is disposed so as to extend in the direction that crosses (is orthogonal to) the moving direction of the fixing belt 411.

The heat receiving member 413 has plural through-holes 413H (only one of which is illustrated in FIG. 3).

Furthermore, the temperature sensor S is provided on the opposite surface 412B side of the heating source 412 as illustrated in FIG. 3. The temperature sensor S is disposed in contact with the opposite surface 412B of the heating source 412 and detects temperature of the heating source 412.

The temperature sensor S is disposed in the through-holes 413H of the heat receiving member 413 and detects temperature of the heating source 412 without interposition of the heat receiving member 413 between the temperature sensor S and the heating source 412.

In the present exemplary embodiment, a portion indicated by the reference sign "3X" in FIG. 3 is a non-contact portion (hereinafter referred to as a "non-contact portion 3X") where the heating source 412 is not in contact with the heat receiving member 413. In other words, in the present exemplary embodiment, the heating source 412 has, at positions corresponding to the through-holes 413H, the non-contact portion 3X that is not covered with the heat receiving member 413 and is not in contact with the heat receiving member 413.

In the present exemplary embodiment, the temperature sensor S is disposed so as to face the non-contact portion 3X (the temperature sensor S is disposed in contact with the non-contact portion 3X), and the temperature sensor S detects temperature of the non-contact portion 3X.

In other words, in the present exemplary embodiment, the heat receiving member 413 is in contact with the opposite surface 412B of the heating source 412, but the heat receiving member 413 is not in contact with the whole of the opposite surface 412B and is in contact with part of the opposite surface 412B.

More specifically, the heat receiving member 413 is in contact with a portion (non-temperature-detection portion) of the opposite surface 412B other than a portion where temperature detection is performed by the temperature sensor S.

In the present exemplary embodiment, in which the temperature sensor S is provided in each of the through-holes 413H, there is a gap (e.g., a gap of 1 mm) between the temperature sensor S and a peripheral edge of the through-hole 413H.

A thermally conductive grease, a high-heat-conductivity adhesive, or the like is desirably interposed between the heat receiving member 413 and the heating source 412 so that the heat receiving member 413 and the heating source 412 are in closer contact with each other.

A change in temperature in the heat receiving member 413 is delayed from a change in temperature in the heating source 412, and therefore if the temperature of the heating source 412 is detected with the heat receiving member 413 interposed between the heating source 412 and the temperature sensor S, there is a risk of failure to accurately detect the temperature of the heating source 412.

Meanwhile, in a case where the temperature of the heating source 412 is directly detected without interposition of the heat receiving member 413 between the heating source 412 and the temperature sensor S as in the present exemplary embodiment, the temperature of the heating source 412 may be more accurately detected without influence of the heat receiving member 413.

Figure 4B:
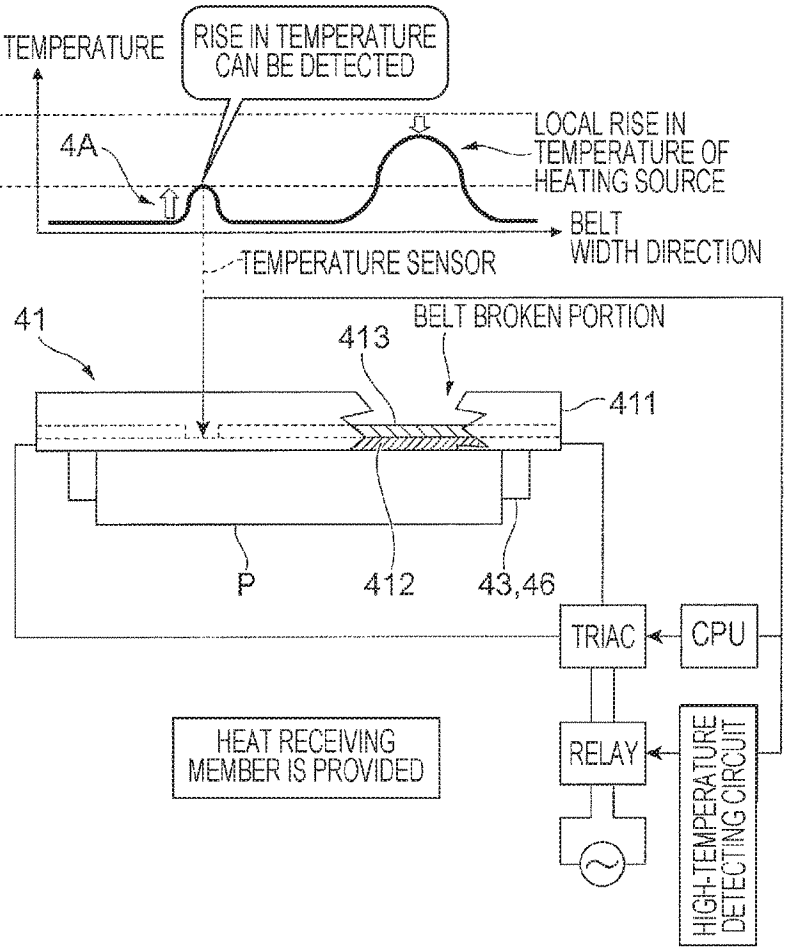
FIGS. 4A and 4B are views for illustrating a role of a heat receiving member.
Figure 4A:
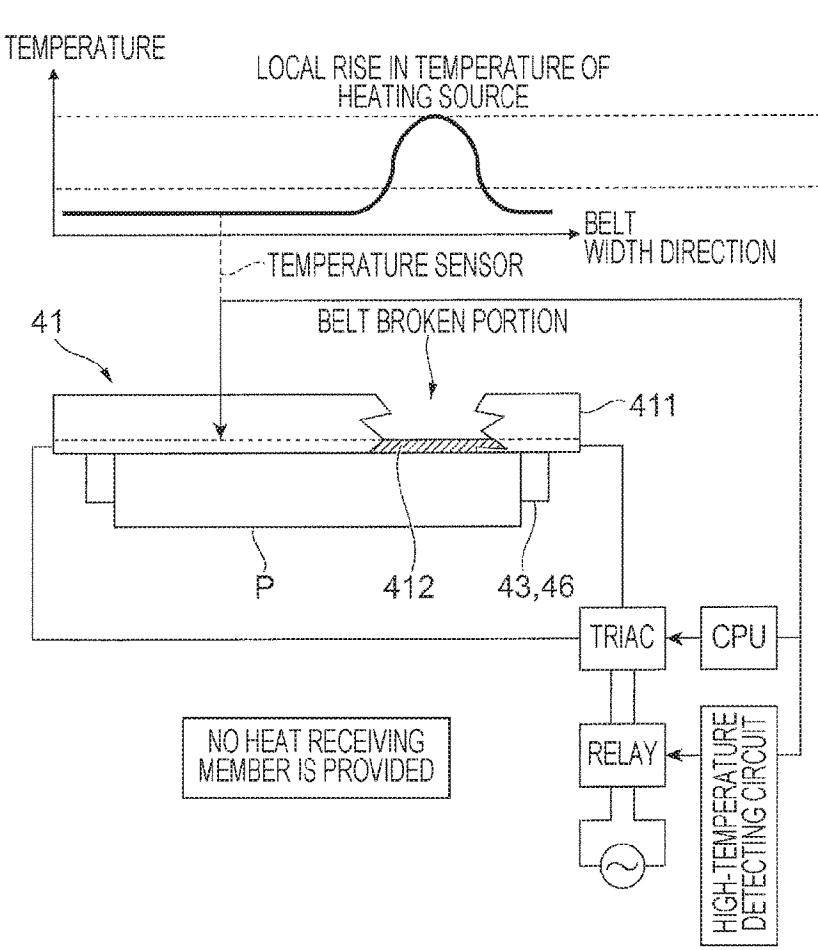

FIGS. 4A and 4B are views for illustrating a role of the heat receiving member 413.

In the configuration according to the present exemplary embodiment, the heating source 412 has a small heat capacity, and it is therefore hard for heat to move in the heating source 412. In this case, in a case where the temperature locally rises in a portion of the heating source 412 as illustrated in FIG. 4A, there is a risk of occurrence of a situation where heat generated in this portion of the heating source 412 does not transmit to the temperature sensor S and the rise in temperature in this portion is not detected.

Specifically, there are cases where the fixing belt 411 is broken as illustrated in FIG. 4A. In such cases, the temperature of the heating source 412 rises at a position facing the broken portion. More specifically, in a case where the fixing belt 411 is broken, it becomes harder for heat of the heating source 412 to transmit to the fixing belt 411 in the broken part. As a result, the temperature of the heating source 412 rises.

In this case, in a case where it is hard for heat to move in the heating source 412, there is a risk of occurrence of a situation where heat in the portion where the temperature of the heating source 412 rises does not transmit to the temperature sensor S and the rise in temperature of the heating source 412 is not detected.

More specifically, in the present exemplary embodiment, in which the temperature of the heating source 412 is controlled by a triac as illustrated in FIG. 4A, it can be assumed that the heating source 412 is forcibly turned on during a non-driving state of the fixing device 40, for example, due to fusion in the triac.

Under such a situation, in a case where the fixing belt 411 is broken, a situation in which the temperature of the heating source 412 locally rises and the rise in temperature is not detected by the temperature sensor S can occur.

Meanwhile, in the configuration according to the present exemplary embodiment, the heat receiving member 413 is disposed in contact with the heating source 412 as illustrated in FIG. 4B. Accordingly, even in a case where temperature rises in a portion of the heating source 412, heat of this portion moves to the heat receiving member 413.

In the present exemplary embodiment, therefore, rise in temperature of the heating source 412 may be kept small as illustrated in FIG. 4B as compared with the configuration illustrated in FIG. 4A in which the heat receiving member 413 is not provided.

Furthermore, in the present exemplary embodiment, even in a case where temperature rises in a portion of the heating source 412, heat of this portion transmits to another portion of the heating source 412 through the heat receiving member 413.

In this case, temperature in a temperature detection portion (a portion where temperature detection is performed by the temperature sensor S) of the heating source 412 rises as indicated by the reference sign "4A" in FIG. 4B, and as a result the rise in temperature of the heating source 412 is detected by the temperature sensor S.

FIGS. 5A through 5D are views for illustrating the heat receiving member 413.

FIG. 5A is a front view of the heat receiving member 413, and FIG. 5B is a view illustrating the heat receiving member 413 viewed from a direction indicated by the arrow VB in FIG. 5A. FIG. 5C is a cross-sectional view taken along line VC-VC in FIG. 5A (a cross-sectional view taken along a contact portion passing plane), and FIG. 5D is a cross-sectional view taken along line VD-VD in FIG. 5A (a cross-sectional view taken along a non-passing plane).

In FIG. 5A, the top-bottom direction is the moving direction of the fixing belt 411, and the left-right direction is the direction that crosses (is orthogonal to) the moving direction of the fixing belt 411 (the width direction of the fixing belt 411).

Hereinafter, the moving direction of the fixing belt 411 is sometimes referred to as a "belt moving direction".

As illustrated in FIG. 5A, the heat receiving member 413 has the plural through-holes 413H. In the present exemplary embodiment, the temperature sensor S is disposed in each of the through-holes 413H. The through-holes 413H are aligned along a longitudinal direction of the heat receiving member 413 (a direction in which the heat receiving member 413 extends).

Furthermore, in the present exemplary embodiment, the temperature sensor S and the heating source 412 (not illustrated in FIGS. 5A through 5D) are in contact with each other in a portion indicated by the reference sign "5A" in FIG. 5A, and the portion indicated by the reference sign "5A" in FIG. 5A is a contact portion (hereinafter referred to as a "contact portion 5A") where the temperature sensor S and the heating source 412 are in contact with each other.

In the present exemplary embodiment, the presence of the through-holes 413H partially reduces a cross-sectional area of the heat receiving member 413.

Specifically, the heat receiving member 413 is disposed so as to extend in the direction (the belt width direction) that crosses (is orthogonal to) the belt moving direction, and a cross-sectional area of the heat receiving member 413 on a plane 5X (flat plane) that crosses (is orthogonal to) this direction in which the heat receiving member 413 extends and is parallel with the belt moving direction is smaller than a cross-sectional area of the other portion of the heat receiving member 413.

More specifically, a cross-sectional area on the plane 5X that crosses (is orthogonal to) the direction in which the heat receiving member 413 extends and is parallel with the belt moving direction and that is a plane passing the contact portion 5A (hereinafter referred to as a "contact portion passing plane 5X") is smaller than a cross-sectional area on a plane 5Y (hereinafter referred to as a "non-passing plane 5Y") that crosses (is orthogonal to) the direction in which the heat receiving member 413 extends and is parallel with the belt moving direction and that is a plane passing a portion other than the contact portion.

More specifically, FIG. 5C illustrates a cross section of the heat receiving member 413 on the contact portion passing plane 5X, and FIG. 5D illustrates a cross section of the heat receiving member 413 on the non-passing plane 5Y. As illustrated in FIGS. 5C and 5D, the cross-sectional area of the heat receiving member 413 on the contact portion passing plane 5X is smaller than the cross-sectional area of the heat receiving member 413 on the non-passing plane 5Y.

In the present exemplary embodiment, the heat receiving member 413 has the through-hole 413H at a position which the contact portion passing plane 5X passes, and the cross-sectional area of the heat receiving member 413 on the contact portion passing plane 5X becomes smaller because of the through-hole 413H.

In a case where the temperature sensor S is provided as in the present exemplary embodiment, there is a risk of occurrence of a situation where heat of the fixing belt 411 is absorbed by the temperature sensor S and the temperature of the fixing belt 411 partially decreases.

Meanwhile, in a case where the cross-sectional area of the heat receiving member 413 on the contact portion passing plane 5X is made smaller as in the present exemplary embodiment, a partial decrease in temperature of the fixing belt 411 resulting from the temperature sensor S may be kept small as compared with the cross-sectional area is not made smaller.

In other words, in a case where the cross-sectional area of the heat receiving member 413 on the contact portion passing plane 5X is made smaller, heat absorbed from the fixing belt 411 by the temperature sensor S may be compensated for by an amount corresponding to the reduction of the cross-sectional area, and therefore a partial decrease in temperature of the fixing belt 411 may be kept small.

FIGS. 6A through 6D illustrate another example of the configuration of the heat receiving member 413.

FIG. 6A is a front view of the heat receiving member 413, and FIG. 6B is a view illustrating the heat receiving member 413 viewed from a direction indicated by the arrow VIB of FIG. 6A. FIG. 6C is a cross-sectional view of the heat receiving member 413 taken along line VIC-VIC of FIG. 6A (a cross-sectional view taken along the contact portion passing plane 5X), and FIG. 6D is a cross-sectional view of the heat receiving member 413 taken along line VID-VID of FIG. 6A (a cross-sectional view taken along the non-passing plane 5Y).

Also in this example, the plural through-holes 413H that are aligned in the direction in which the heat receiving member 413 extends are provided as illustrated in FIG. 6A.

Furthermore, in this example, a thickness of a portion of the heat receiving member 413 is smaller than a thickness of the other portion of the heat receiving member 413. Specifically, in this example, the heat receiving member 413 has, on the opposite surface 412B, a grooves 413M that extends in the moving direction of the fixing belt 411, and the thickness of the portion of the heat receiving member 413 is made smaller than the thickness of the other portion of the heat receiving member 413 because of the groove 413M.

Also in this example, the cross-sectional area of the heat receiving member 413 on the contact portion passing plane 5X is smaller than the cross-sectional area of the heat receiving member 413 on the non-passing plane 5Y. Accordingly, also in this example, a partial decrease in temperature of the fixing belt 411 resulting from the temperature sensor S may be kept small.

In particular, in this example, the cross-sectional area of the heat receiving member 413 on the contact portion passing plane 5X is further made smaller because of the presence of the groove 413M. Accordingly, even in a case where the temperature sensor S has a large heat capacity and a partial decrease in temperature of the fixing belt 411 resulting from the temperature sensor S is large, the decrease in temperature may be kept small.

FIGS. 7A through 7D illustrate another example of the configuration of the heat receiving member 413.

FIG. 7A is a front view of the heat receiving member 413, and FIG. 7B is a view illustrating the heat receiving member 413 viewed from a direction indicated by the arrow VIIB of FIG. 7A. FIG. 7C is a cross-sectional view of the heat receiving member 413 taken along line VIIC-VIIC of FIG. 7A (a cross-sectional view taken along the contact portion passing plane 5X), and FIG. 7D is a cross-sectional view of the heat receiving member 413 taken along line VIID-VIID of FIG. 7A (a cross-sectional view taken along the non-passing plane 5Y).

In this example, the heat receiving member 413 has plural cutouts 413K as illustrated in FIG. 7A. The plural cutouts 413K are aligned in the direction in which the heat receiving member 413 extends.

Each of the plural cutouts 413K has an opening 89 on a downstream side edge 81 among four edges of the heat receiving member 413 and extends from the downstream side edge 81 toward an upstream side edge 82 as illustrated in FIG. 7A.

More specifically, the heat receiving member 413 has a rectangular shape and has the downstream side edge 81 located on a downstream side in the belt moving direction, the upstream side edge 82 located on an upstream side in the belt moving direction, and two side edges 83 and 84 that connect the downstream side edge 81 and the upstream side edge 82. Each of the cutouts 413K has the opening 89 on the downstream side edge 81 and extends from the downstream side edge 81 toward the upstream side edge 82.

In this example, a case where the opening 89 is provided on the downstream side edge 81 has been described. Alternatively, each of the cutouts 413K may have the opening 89 on the upstream side edge 82 and extend from the opening 89 toward the downstream side edge 81.

Furthermore, in this example, each of the cutouts 413K is provided along the moving direction of the fixing belt 411 (the belt moving direction) as illustrated in FIG. 7A.

In this example, the temperature sensor S is disposed in each of the cutouts 413K. The temperature sensor S detects temperature of a non-contact portion 3X, of the heating source 412 (not illustrated in FIGS. 7A through 7D), that is not covered with the heat receiving member 413 and is not in contact with the heat receiving member 413 (a portion, of the heating source 412, corresponding to the cutouts 413K).

FIG. 7C illustrates a cross section of the heat receiving member 413 on the contact portion passing plane 5X, and FIG. 7D illustrates a cross section of the heat receiving member 413 on the non-passing plane 5Y.

Because of the presence of the cutouts 413K, the cross-sectional area of the heat receiving member 413 on the contact portion passing plane 5X is smaller than the cross-sectional area of the heat receiving member 413 on the non-passing plane 5Y also in this example, as illustrated in FIGS. 7C and 7D.

Also in this example, the cross-sectional area of the heat receiving member 413 on the contact portion passing plane 5X is further made smaller than that in the configuration in which only the through-holes 413H are provided (the configuration illustrated in FIG. 5).

In this case, even in a case where the temperature sensor S has a large heat capacity and a partial decrease in temperature of the fixing belt 411 resulting from the temperature sensor S is large, this decrease in temperature may be kept small, as in the above example in which the heat receiving member 413 has the groove 413M.

In a case where each of the cutouts 413K is provided along the moving direction of the fixing belt 411 (the belt moving direction) as in the example illustrated in FIGS. 7A through 7D, a region where unevenness of temperature of the fixing belt 411 occurs may be reduced as compared with a case where each of the cutouts 413K is provided along the direction that crosses the moving direction of the fixing belt 411 (the width direction of the fixing belt 411).

In a case where each of the cutouts 413K is provided along the direction that crosses the moving direction of the fixing belt 411 (the width direction of the fixing belt 411), a region where the cutouts 413K are provided expands in the width direction of the fixing belt 411.

In the region where the cutouts 413K are provided, an amount of heat moving from the fixing belt 411 to the heat receiving member 413 decreases, and therefore the temperature of the fixing belt 411 rises. Meanwhile, in a region where the cutouts 413K are not provided, a larger amount of heat moves from the fixing belt 411 to the heat receiving member 413, and the temperature of the fixing belt 411 becomes lower than that in the region where the cutouts 413K are provided.

In such cases, in a case where each of the cutouts 413K is provided not along the width direction of the fixing belt 411 but along the moving direction of the fixing belt 411, the region where the cutouts 413K are provided becomes smaller in the width direction of the fixing belt 411.

In this case, a region where the temperature of the fixing belt 411 rises is reduced or eliminated, and the region where unevenness of the temperature of the fixing belt 411 occurs becomes small.

Figure 8A:
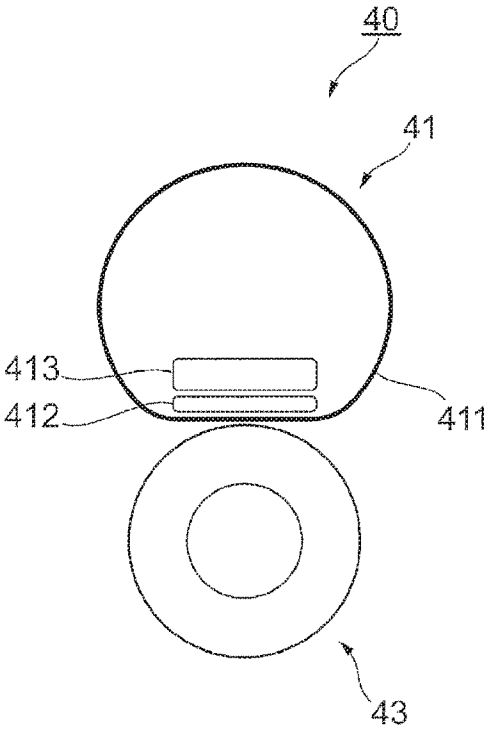
FIGS. 8A through 8C illustrate another example of the configuration of the fixing device.
Figure 8B:
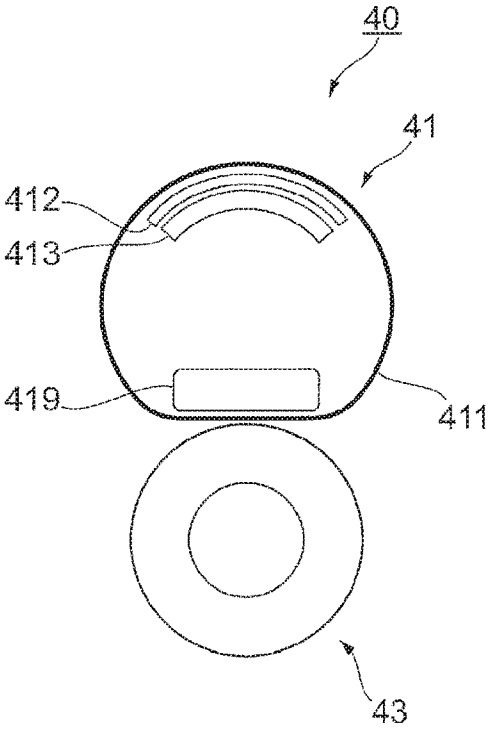
Figure 8C:
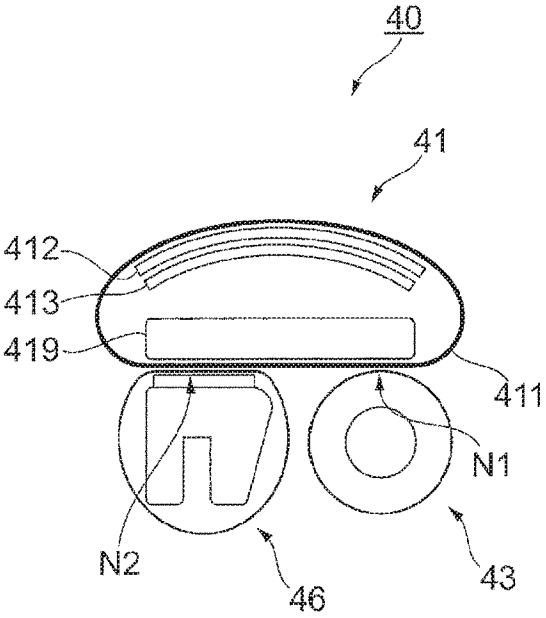

FIGS. 8A through 8C illustrate another example of the configuration of the fixing device 40.

The configuration in which two members (i.e., the driving roll 43 and the pressing belt module 46) are pressed against the heating belt module 41 has been described above. However, it is also possible to employ a configuration in which a single member is pressed against the heating belt module 41.

In the example illustrated in FIGS. 8A and 8B, only the driving roll 43 is pressed against the heating belt module 41, and the sheet of paper P is pressed at a single position.

In the example illustrated in FIG. 8A, the heating source 412 and the heat receiving member 413 are provided on an inner side of the fixing belt 411 so as to face the driving roll 43 as in the example described above. The temperature sensor S is disposed in the through-holes 413H or the cutouts 413K of the heat receiving member 413 (not illustrated) as in the above example. Also in this example, the temperature of the heating source 412 is detected without interposition of the heat receiving member 413 between the temperature sensor S and the heating source 412.

In the example illustrated in FIG. 8B, a pad-like member 419 is provided on an inner side of the fixing belt 411 so as to face the driving roll 43.

In this example, pressure from the driving roll 43 is received by the pad-like member 419. In the example illustrated in FIG. 8B, the heating source 412 and the heat receiving member 413 are provided on an inner side of the fixing belt 411 so as not to face the driving roll 43.

Also in this example, the temperature sensor S is disposed in the through-holes 413H or the cutouts 413K of the heat receiving member 413 (not illustrated), and the temperature of the heating source 412 is detected without interposition of the heat receiving member 413 between the temperature sensor S and the heating source 412.

In the example illustrated in FIG. 8C, the driving roll 43 and the pressing belt module 46 are pressed against the heating belt module 41 as in the example illustrated in FIG. 3.

In this example, the pad-like member 419 is provided on an inner side of the fixing belt 411 so as to be located behind the downstream side contact portion N1 and the upstream side contact portion N2 (so as to face the driving roll 43 and the pressing belt module 46).

In the example illustrated in FIG. 8C, pressure from the driving roll 43 and the pressing belt module 46 is received by the pad-like member 419.

In this example, the heating source 412 and the heat receiving member 413 are provided on an inner side of the fixing belt 411 so as not to be located behind the downstream side contact portion N1 and the upstream side contact portion N2 (on a side opposite to a side where the pad-like member 419 is provided).

Also in this example, the temperature sensor S is disposed in the through-holes 413H or the cutouts 413K of the heat receiving member 413 (not illustrated), and the temperature of the heating source 412 is detected without interposition of the heat receiving member 413 between the temperature sensor S and the heating source 412.

Figure 9:
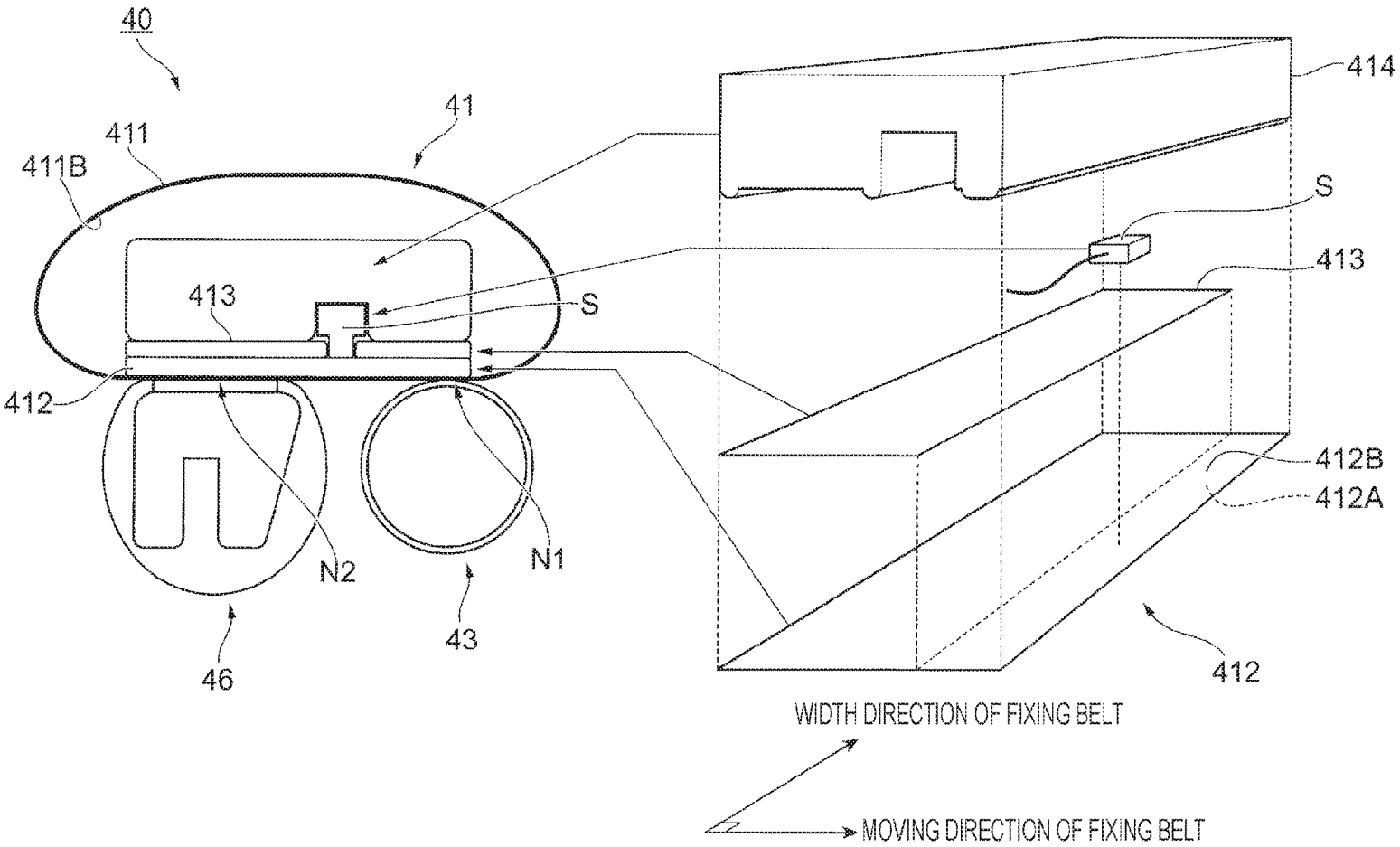
FIG. 9 illustrates another example of the configuration of the fixing device.

FIG. 9 illustrates another example of the configuration of the fixing device 40.

In this example, the heat receiving member 413 has no through-hole 413H and no cutout 413K. In this example, the heat receiving member 413 is smaller than the heating source 412, and a portion of the opposite surface 412B of the heating source 412 is not covered with the heat receiving member 413 and is exposed. In this example, the temperature sensor S is disposed in contact with the exposed portion and detects temperature of this portion.

Direct detection of the temperature of the heating source 412 may be performed by providing the through-holes 413H or the cutouts 413K as described above or may be performed by making the heat receiving member 413 smaller than the heating source 412 as in this example.

In this example, a portion, of the heating source 412, where temperature detection is performed by the temperature sensor S is a downstream side portion, of the heating source 412, located on a downstream side in the belt moving direction.

In the present exemplary embodiment, when the fixing belt 411 that circulates reaches the heating source 412, the fixing belt 411 whose temperature has been lowered makes contact with an upstream side portion, of the heating source 412, on an upstream side in the belt moving direction. In this case, the temperature of the upstream side portion of the heating source 412 decreases, and temperature of a downstream side portion of the heating source 412 increases.

In a case where the temperature of the downstream side portion of the heating source 412 is detected as in the example illustrated in FIG. 9, temperature of a portion having a higher temperature is detected.

In this case, for example, in a case where the temperature of the heating source 412 rises, temperature of a portion whose temperature rises earliest is detected first, and the rise in temperature of the heating source 412 is detected at an earlier timing.

The temperature sensor S may be disposed at a different position.

In the example illustrated in FIG. 3, the temperature sensor S is provided on an upstream side in the belt moving direction relative to the downstream side contact portion N1 and on a downstream side in the belt moving direction relative to the upstream side contact portion N2.

In other words, in the example illustrated in FIG. 3, temperature of a portion, of the heating source 412, located on an upstream side in the belt moving direction relative to the downstream side contact portion N1 and on a downstream side in the belt moving direction relative to the upstream side contact portion N2 is detected by the temperature sensor S.

In other words, in the example illustrated in FIG. 3, temperature of a portion, of the heating source 412, located between two contact portions (nip portions) is detected.

In the downstream side contact portion N1, the driving roll 43 is disposed so as to face the heating source 412, and in the upstream side contact portion N2, the pressing belt module 46 is disposed so as to face the heating source 412. Accordingly, in the downstream side contact portion N1 and the upstream side contact portion N2, heat of the heating source 412 easily escapes to these members.

Meanwhile, between the downstream side contact portion N1 and the upstream side contact portion N2, members such as the driving roll 43 and the pressing belt module 46 are not provided so as to face the heating source 412, and therefore heat of the heating source 412 does not escape, and the temperature of the heating source 412 easily rises.

Especially in a case where the heating source 412 is forcibly turned on, for example, due to fusion of a triac during stoppage of the fixing belt 411, the temperature of the heating source 412 easily rises between the downstream side contact portion N1 and the upstream side contact portion N2.

In the example illustrated in FIG. 3, the temperature of the heating source 412 is detected between the downstream side contact portion N1 and the upstream side contact portion N2 between which the temperature easily rises. In this case, in a case where the temperature of the heating source 412 rises, the rise in temperature is detected at an earlier timing as in the above case.

In the example illustrated in FIGS. 1 through 9, a case where the contact-type temperature sensor S is used has been described. Alternatively, a non-contact-type temperature sensor S that is provided so as not to be in contact with the heating source 412 may be used as the temperature sensor S.

In a case where a non-contact-type temperature sensor S is used, the temperature of the heating source 412 is detected through the through-holes 413H or the cutouts 413K of the heat receiving member 413.

In a case where a non-contact-type temperature sensor S is used in the configuration in which the heat receiving member 413 is smaller than the heating source 412 as in the example illustrated in FIG. 9, the temperature of the heating source 412 is detected by disposing the temperature sensor S at a position facing a portion, of the heating source 412, that is not covered with the heat receiving member 413.

A case where the heat receiving member 413 has either the through-holes 413H or the cutouts 413K has been described above. Alternatively, the heat receiving member 413 may have both of the through-holes 413H and the cutouts 413K.

A case where the heat receiving member 413 has the groove 413M and the through-holes 413H has been described in FIGS. 6A through 6D as an example. Alternatively, the heat receiving member 413 may have the groove 413M and the cutouts 413K. Alternatively, the heat receiving member 413 may have the groove 413M, the through-holes 413H, and the cutouts 413K.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a belt member used to fix an image on a recording material;

a heating source that has a facing surface facing the belt member and an opposite surface and heats the belt member;

a heat receiving member that is disposed in contact with the opposite surface of the heating source and receives heat from the heating source; and a temperature detector that is provided on an opposite surface side of the heating source and detects temperature of the heating source without interposition of the heat receiving member between the heating source and the temperature detector, wherein the heat receiving member has an opening on a downstream side edge or an upstream side edge in a moving direction of the belt member, and the temperature detector is configured to be in contact with the heating source via the opening.

2. The fixing device according to claim 1, wherein the heat receiving member has a cutout and/or a through-hole;

the heating source has, at a position thereof corresponding to the cutout or the through-hole, a non-contact portion that is not covered with the heat receiving member and is not in contact with the heat receiving member; and the temperature detector detects temperature of the non-contact portion of the heating source.

3. The fixing device according to claim 2, wherein the cutout is provided along a moving direction of the belt member.

4. An image forming apparatus comprising:

an image forming part that forms the image on the recording material; and the fixing device fixes the image on the recording material on which the image has been formed by the image forming part, wherein the fixing device is the fixing device according to claim 2.

5. An image forming apparatus comprising:

an image forming part that forms the image on the recording material; and the fixing device fixes the image on the recording material on which the image has been formed by the image forming part, wherein the fixing device is the fixing device according to claim 3.

6. The fixing device according to claim 1, wherein the temperature detector is disposed in contact with the heating source;

the temperature detector and the heating source are in contact with each other in a contact portion;

the heat receiving member is disposed so as to extend in a direction that crosses a belt moving direction that is a moving direction of the belt member;

a cross-sectional area of the heat receiving member on a plane crossing the direction in which the heat receiving member extends and passing the contact portion is smaller than a cross-sectional area of the heat receiving member on a plane crossing the direction in which the heat receiving member extends and passing a portion other than the contact portion.

7. The fixing device according to claim 6, wherein a thickness of the heat receiving member on the plane passing the contact portion is smaller than a thickness of the heat receiving member on the plane passing the portion other than the contact portion.

8. The fixing device according to claim 6, wherein the heat receiving member has a through-hole and/or a cutout at a position which the plane passing the contact portion passes.

9. An image forming apparatus comprising:

an image forming part that forms the image on the recording material; and the fixing device fixes the image on the recording material on which the image has been formed by the image forming part, wherein the fixing device is the fixing device according to claim 6.

10. An image forming apparatus comprising:

an image forming part that forms the image on the recording material; and the fixing device fixes the image on the recording material on which the image has been formed by the image forming part, wherein the fixing device is the fixing device according to claim 7.

11. An image forming apparatus comprising:

an image forming part that forms the image on the recording material; and the fixing device fixes the image on the recording material on which the image has been formed by the image forming part, wherein the fixing device is the fixing device according to claim 8.

12. The fixing device according to claim 1, further comprising:

a downstream side pressing member that is in contact with the belt member in a downstream side contact portion and presses the recording material transported between the belt member and the downstream side pressing member; and an upstream side pressing member that is disposed on an upstream side, relative to the downstream side pressing member, in a belt moving direction that is a moving direction of the belt member, is in contact with the belt member in an upstream side contact portion, and presses the recording material transported between the belt member and the upstream side pressing member, wherein the temperature detector detects temperature of a portion, of the heating source, located on an upstream side in the belt moving direction relative to the downstream side contact portion and on a downstream side in the belt moving direction relative to the upstream side contact portion.

13. An image forming apparatus comprising:

an image forming part that forms the image on the recording material; and the fixing device fixes the image on the recording material on which the image has been formed by the image forming part, wherein the fixing device is the fixing device according to claim 12.

14. The fixing device according to claim 1, wherein the temperature detector detects temperature of the heating source in a portion of the heating source located on a downstream side in a moving direction of the belt member.

15. An image forming apparatus comprising:

an image forming part that forms the image on the recording material; and the fixing device fixes the image on the recording material on which the image has been formed by the image forming part, wherein the fixing device is the fixing device according to claim 14.

16. An image forming apparatus comprising:

an image forming part that forms the image on the recording material; and the fixing device fixes the image on the recording material on which the image has been formed by the image forming part, wherein the fixing device is the fixing device according to claim 1.

17. A fixing device comprising:

a belt member used to fix an image on a recording material;

a heating source that faces the belt member, has a facing surface facing the belt member and an opposite surface, and heats the belt member;

a temperature detector that detects temperature of the opposite surface of the heating source; and a heat receiving member that is disposed in contact with the opposite surface of the heating source in a portion where temperature detection is not performed by the temperature detector and receives heat from the heating source, wherein the heat receiving member has an opening on a downstream side edge or an upstream side edge in a moving direction of the belt member, and the temperature detector is configured to be in contact with the heating source via the opening.

18. An image forming apparatus comprising:

an image forming part that forms the image on the recording material; and the fixing device fixes the image on the recording material on which the image has been formed by the image forming part, wherein the fixing device is the fixing device according to claim 17.

* * * * *